US005237819A

United States Patent [19]

Hopkins et al.

[11] Patent Number: 5,237,819

[45] Date of Patent: Aug. 24, 1993

[54] PILOT CONTROL CIRCUIT WITH PRESELECTED ACTUATION DELAYS

[75] Inventors: Delaney C. Hopkins, Dwight; James L. Vocu, Joliet, both of Ill.

[73] Assignee: Caterpillar Inc., Peoria, Ill.

[21] Appl. No.: 838,011

[22] Filed: Feb. 21, 1992

[51] Int. Cl.[5] ..... F16D 31/02

[52] U.S. Cl. ..... 60/444; 60/487; 91/461

[58] Field of Search ..... 60/394, 431, 487, 493, 60/494, 444, 445, 489, 464; 91/461, 444

[56] References Cited

U.S. PATENT DOCUMENTS

| | | | |
|---|---|---|---|
| 3,354,637 | 11/1967 | Crosswhite | 60/489 |
| 4,408,453 | 10/1983 | Westveer | 60/445 |
| 4,481,770 | 11/1984 | Lohbauer et al. | 60/445 X |
| 4,756,156 | 7/1988 | Appel | 60/487 X |
| 4,869,065 | 9/1989 | Hopkins | 60/493 X |
| 5,046,309 | 9/1991 | Yoshino | 60/445 |

*Primary Examiner*—Edward K. Look
*Assistant Examiner*—Hoang Nguyen
*Attorney, Agent, or Firm*—John W. Grant

[57] ABSTRACT

Reversible hydraulic motors driven by fluid from variable displacement pumps are useful in driving various mechanisms of earthmoving machines. The subject pilot control circuit includes a pilot operated valve in each of a pair of signal passages which communicate a pilot signal from a control valve to a pump displacement control. The pilot operated valve in one of the signal passages is shifted to a position blocking fluid flow therethrough by the pilot signal in the other signal passage. An accumulator means stores a portion of the pilot signal from the other signal passage and causes the pilot operated valve in the one signal passage to remain in the blocking position for a predetermined time after the pilot signal is vented from the other signal passage.

7 Claims, 1 Drawing Sheet

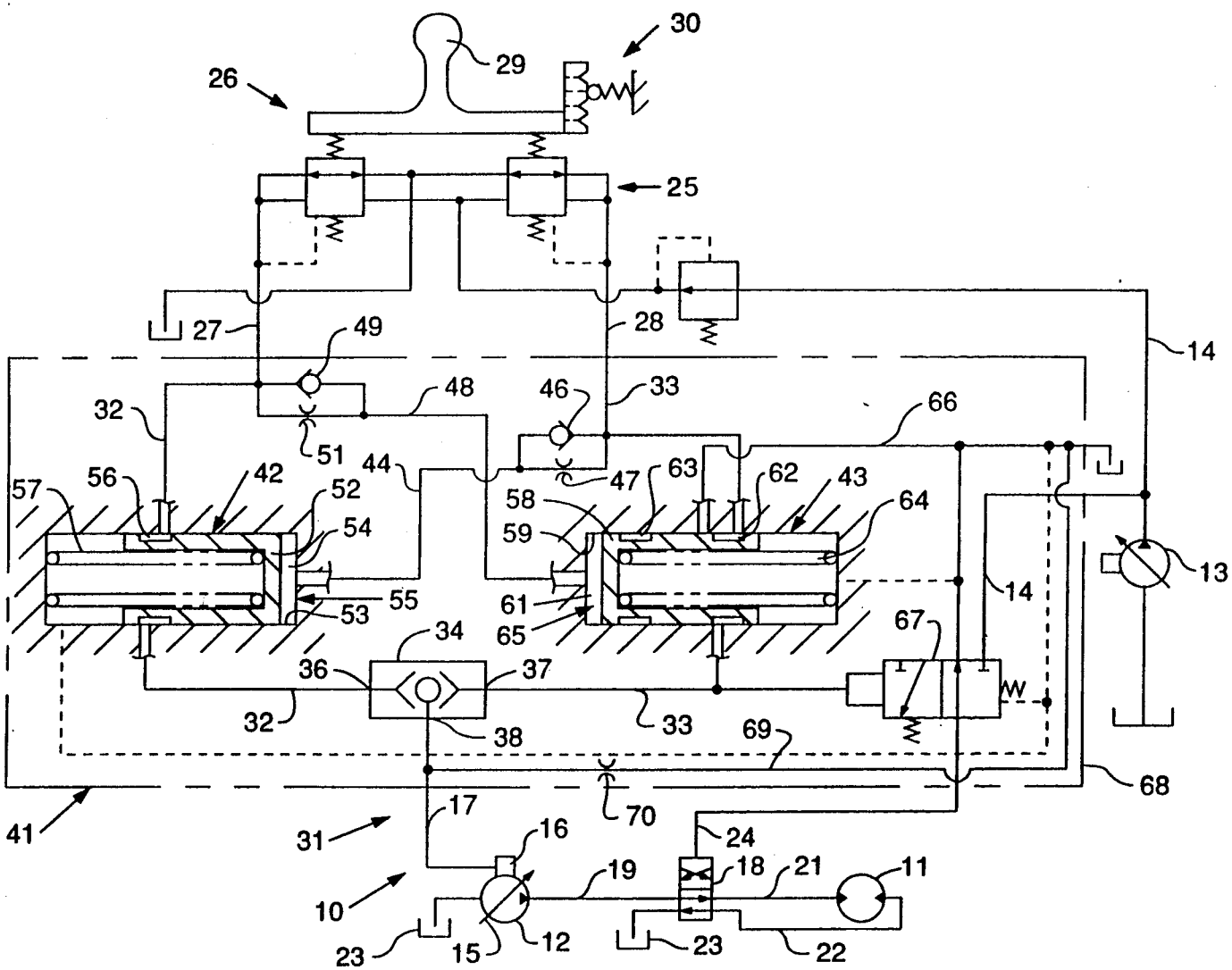
30
29
26
25
28
27
33
48
49
46
47
51
44
32
56
57
42
52
54
55
53
58
59
61
65
43
62
63
64
66
14
13
68
67
69
70
37
38
34
36
17
16
15
12
19
18
24
21
22
11
23
10
31
41

PILOT CONTROL CIRCUIT WITH PRESELECTED ACTUATION DELAYS

DESCRIPTION

1. Technical Field

This invention relates to a hydraulic control circuit and more particularly to a circuit having preselected actuation delays when the rotational direction of the motor is changed.

2. Background Art

Many earthmoving machines have mechanisms driven by a hydraulic motor which receives pressurized fluid from a hydraulic pump. One example of such mechanism is an elevating scraper in which the elevating mechanism is hydraulically driven by a hydraulic motor. The elevating mechanism is driven in a first direction by directing pressurized fluid from the pump to one side of the motor and a second direction by directing pressurized fluid from the pump to the other side of the motor. Such elevating mechanism is generally quite heavy and generates substantial amounts of inertia energy once it is in motion. If the direction of the drive motor is reversed while the elevating mechanism is in motion, high shock loads are imparted to the entire machine. To prevent the generation of such shock loads some elevating scrapers have a mechanical latch which physically stops the control lever associated with controlling the drive motor at the neutral position. The mechanical latch must then be manually moved by the operator before the control lever can be put in a position to drive the motor in the opposite direction. Stopping the control lever momentarily in the neutral position allows the elevating mechanism to coast to a stop so that by the time the control lever is moved to the other operating position the inertia energy has decayed. One of the problems with such mechanical latch is that it requires several hand movements by the operator to change the driving direction of the elevating mechanism. Such hand movements require the operator to expend additional energy each time he changes the drive direction of the elevating mechanism.

The present invention is directed to overcoming one or more of the problems as set forth above.

SUMMARY OF THE INVENTION

In one aspect of the present invention a pilot control circuit is provided for controlling a hydraulic system including a reversible hydraulic motor, a variable displacement pump connected to the motor and having a pilot operated displacement control, and a reversing valve disposed between the pump and the motor and being movable between forward and reverse drive positions. The pilot control circuit includes a source of pressurized pilot fluid, a control valve connected to the source of pressurized pilot fluid and being movable between a first position to output a first regulated pressure pilot signal and a second position to output a second regulated pressure pilot signal, and a means for communicating the first or second pilot signal to the displacement control of the pump. A delay means is provided for delaying the communication of the first or second signal to the displacement control for a predetermined period of time after the control valve is moved between the first and second positions.

BRIEF DESCRIPTION OF THE DRAWINGS

The sole figure is a schematic illustration of an embodiment of the present invention.

BEST MODE FOR CARRYING OUT THE INVENTION

A hydraulic control system 10 is provided for operating a reversible hydraulic motor 11 which can be utilized to drive an elevating mechanism (not shown) of an elevating scraper. The hydraulic system 10 includes a variable displacement hydraulic pump 12 and a source of pressurized pilot fluid such as a pump 13 connected to a pilot fluid supply line 14. The pump 12 includes a movable swash plate 15 and a displacement control 16 adapted to control the angle or position of the swash plate 15 and thereby regulate the volumetric output of the pump. The displacement control 16 is of the type in which the swash plate 15 is moved toward the maximum displacement position in response to receiving a pressurized pilot signal. The pump 12 is preferably of the type in which the swash plate is forcibly retained at a zero displacement position in the absence of the pilot signal. A signal line 17 is connected to the displacement control.

A pilot operated reversing valve 18 is connected to the variable displacement pump 12 through a supply conduit 19 and to the hydraulic motor 11 through a pair of motor conduits 21,22. The reversing valve 18 is movable between a first position at which the supply conduit 19 is communicated with the motor conduit 21 and the motor conduit 22 is communicated with a tank 23 and a second position at which the supply conduit 19 is in communication with the motor conduit 22 and the motor conduit 21 is in communication with the tank 23. A pilot line 24 is connected to the reversing valve 18. The reversing valve 18 is resiliently biased to the first position and is urged to the second position when a pilot signal is present in the pilot line 24.

A pilot control circuit 25 is operatively connected to the system 10 and includes a manually actuated control valve 26 having a pair of pilot outlet ports 27,28 and being connected to the pilot supply line 14. The control valve has an operator controlled handle 29 operatively connected thereto and is shown at a neutral position at which the pilot supply line 14 is blocked from both of the outlet ports. The handle 29 is movable in a clockwise direction to a first operating or reverse drive position at which a regulated pressure pilot signal is outputted through the outlet port 28, or in a counterclockwise direction to a second operating or first speed forward drive position at which a regulated pressure pilot signal is outputted through the outlet port 27 at a predetermined pressure level, or a third operating or second speed forward drive position at which the regulated pressure pilot signal outputted through the outlet port 27 is increased to a second predetermined level. A detent mechanism 30 is provided to retain the control handle in the selected operating position.

A means 31 is provided for communicating the first or second pilot signals to the displacement controller 16. The communicating means 31 includes the pilot line 17, a pair of signal passages 32,33 connected to the outlet ports 27,28, a shuttle valve 34 having a pair of inlet ports 36,37 connected to the signal passages 32,33 and an outlet port 38 connected to the pilot line 17. The shuttle valve 34 constitutes a valve means for selectively communicating one of the first or second signal passages to the pilot line 17.

A delay means 41 is provided for delaying the communication of the first or second pilot signals to the displacement controller 16 for a predetermined period of time after the control valve 26 is moved between the forward and reverse drive positions. The delay means 41 includes a pair of pilot operated delay valves 42,43 disposed within the signal passages 32,33, respectively, a pilot passage 44 connecting the signal passage 33 to the delay valve 42 through a check valve 46 and an orifice 47, and a pilot passage 48 connecting the signal passage 32 to the delay valve 43 through a check valve 49 and an orifice 51.

The delay valve 42 includes a spool 52 slidably disposed in a bore 53 and defining a chamber 54 in communication with the pilot passage 44. The spool 52 has an annular groove 56 which establishes communication through the signal passage 32 when the spool is at the position shown. The spool is biased to the position shown by a spring 57 and is moved leftward to a position blocking communication through the signal passage 32 when pressurized pilot fluid is directed into the chamber. The chamber 54 acts as both an actuating chamber and an accumulator means 55 for storing a preselected volume of pressurized fluid.

The delay valve 43 also includes a spool 58 slidably disposed in a bore 59 and defining a chamber 61 in communication with the pilot passage 48. The spool 58 has a pair of axially spaced annular grooves 62,63 with the groove 62 establishing communication through the signal passage 33 when the spool is at the position shown. The spool 58 is biased to the position shown by a spring 64 and is moved leftward to a position blocking communication through the signal passage 33 when pressurized pilot fluid is directed into the chamber. The chamber 61 acts as both an actuating chamber and an accumulator means 65 for storing a preselected volume of pressurized fluid. The groove 63 communicates the signal passage 33 between the delay valve 43 and the shuttle valve 34 with a drain line 66 when the spool 58 is at the leftward position.

Alternatively, the accumulator means 55,65 can include a pair of separate accumulators connected to the pilot passages 32,33.

A pilot operated valve 67 is connected to the pilot supply line 14, the pilot line 24, and to the drain line 66. The valve 67 is movable between a first position at which the pilot line 24 is communicated with the drain line 66 and blocked from the supply pilot line 14, and a second position at which the pilot line 24 is in communication with the pilot supply line 14. The valve 67 is resiliently urged to the first position. The valve 67 is connected to the signal passage 33 between the delay valve 43 and the shuttle valve 34 and is moved to the second position when pressurized fluid is directed through the pilot line 33 to the displacement control.

A vent passage 69 communicates the outlet port 38 with the drain line 66 through an orifice 70 to prevent fluid from being trapped in the displacement controller 16.

In the present embodiment the components enclosed within the phantom line indicated at 68 are contained within the same body.

INDUSTRIAL APPLICABILITY

The delay means 41 is effective only when the control handle 29 is being shifted between the forward and reverse positions with no intermediate stop at the neutral position. For example, when the control handle is at the position shown the pilot passages 44 and 48 and thus the chambers 54,61 are communicated with the tank 23 through the respective orifices 47,51 and through the control valve 26 to the tank 23. Thus, the pilot operated valves 42,43 and 67 would be in the position shown. If the control handle 29 is thus shifted to a forward position from the neutral position, a pilot signal is outputted through the outlet port 27, the signal passage 32, the pilot operated valve 42, the shuttle valve 36, and the pilot line 17 to the displacement control 16. The pilot signal entering the displacement control 16 causes the swash plate 15 to move to a predetermined position to direct pressurized fluid through the conduit 19, the reversing valve 18, and the conduit 21 to the motor 11 to drive it in the forward direction. The pressurized pilot signal in the signal passage 32 also passes through the pilot passage 48 and the check valve 49 and into the chamber 61 of the valve 43. Initially, the pilot signal entering the chamber 61 moves the spool 58 rightwardly against the bias of the spring 64 to the position at which fluid flow through the pilot line 33 is blocked. The pilot signal continues to enter the chamber 61 causing further rightward movement of the spool until it reaches a position at which the end of the pilot operated valve 67 is communicated with the tank. The chamber 61 holds a predetermined volume of the pilot signal and thus acts as an accumulator. The chamber 61 will remain filled with fluid and the pilot operated valve 43 will remain in the extreme rightward position as long as the control handle 29 is maintained at the forward drive position.

If the control handle 29 is moved from the forward drive position directly to the reverse drive position without stopping at the neutral position a pilot signal is immediately outputted through the outlet port 28 and into the signal passage 33. However, the pilot operated valve 43 remains in the blocking position until the pressurized fluid in the chamber 61 of the valve 43 has bled through the orifice 51, the signal passage 32 and the control valve 26. The volume of the chamber 61 and the size of the orifice 51 are selected so that the spool 58 of the valve 43 does not reach the position for establishing communication through the signal passage 33 for a predetermined period of time to permit the pump to destroke to the zero displacement position and the inertia forces in the elevating mechanism decay such that the motor 11 comes to a stop. At the end of the predetermined period of time, the spool 58 of the valve 43 reaches the position at which the pilot signal in the signal passage 33 passes therethrough and through the shuttle valve 34 and the pilot line 17 to the displacement controller 16. The pilot signal passing through the valve 43 is also simultaneously directed to the pilot operated valve 67 to shift it to the position at which pressurized fluid in the pilot supply line 14 passes through the pilot line 24 to shift the valve 18 to its other position for reversing fluid flow through the hydraulic motor 11.

At the same time that the pressurized fluid was being bled from the chamber 61 the pressurized pilot signal in the signal passage 33 passes through the check valve 46 and into the pilot passage 44. The pilot signal in the pilot passage 44 initially enters the chamber 54 of the valve 42 to shift the spool 52 leftwardly to its blocking position and then fills the chamber 54 with a predetermined volume of pressurized fluid. Thus, when the handle 29 is subsequently moved from the reverse drive position back to the forward position the actuation of the hydraulic system would not occur until the volume of fluid stored in the chamber 54 has bled through the orifice 47 similar to that previously described.

In view of the foregoing, it is readily apparent that the structure of the present invention provides an improved pilot control circuit for controlling operation of a hydraulic system in which the changing of the rotational direction of the motor is automatically delayed for a predetermined period of time when the control handle is moved between the forward and reverse drive positions. This is accomplished by providing a pilot operated valve in each of the pilot signal passages with each valve having a chamber connected to the opposite signal passage. The chambers are sized to store pressurized pilot fluid when the associated pilot operated valve is in the blocking position. The stored fluid in the chamber maintains the pilot operated valve in the blocking position until such fluid is bled through an orifice. The volumetric capacity of the chambers and the size of the orifice are sized so that the inertia forces acting on the hydraulic motor have dissipated before the pilot operated valve is shifted to the open position.

Other aspects, objects and advantages of this invention can be obtained from a study of the drawings, the disclosure and the appended claims.

We claim:

1. A pilot control circuit for controlling a hydraulic system including a reversible hydraulic motor, a variable displacement pump connected to the motor and having a pilot operated displacement controller, and a reversing valve disposed between the pump and motor and being movable between first and second drive positions comprising:

a source of pressurized pilot fluid;

a control valve connected to the source of pressurized pilot fluid and movable between a first position for outputting a first regulated pressure pilot signal and a second position for outputting a second regulated pilot signal;

means for communicating the first or second pilot signal to the pump displacement controller including a pair of signal passages connected to the control valve, a pilot line connected to the pump displacement controller and valve means for selectively communicating one of the first and second signal passages to the pilot line; and delay means for delaying the communication of the first or second pilot signals to the pump displacement control for a predetermined period of time after the control valve is moved between the first and second positions, the delay means including a pilot operated valve disposed in the first signal passage, a pilot passage connecting the second signal passage to the pilot operated valve, accumulator means for storing a predetermined volume of the second pilot signal passing through the pilot passage, and an orifice dispose din the pilot passage at a location sufficient for restricting fluid flow between the accumulator means and the second pilot passage.

2. The pilot control circuit of claim 1 wherein the delay means includes another pilot operated valve disposed in the second signal passage, another pilot passage connecting the another pilot operated valve to the first signal passage, another accumulator means for storing a predetermined volume of the first pilot signal passing through the another pilot passage, and another orifice disposed in the second pilot passage at a location sufficient for restricting fluid flow from the accumulator means to the first signal passage.

3. The pilot control circuit of claim 1 wherein the delay means includes a check valve disposed in parallel with the orifice in the pilot passage, and another check valve disposed in parallel with the another orifice in the second pilot passage.

4. The pilot control circuit of claim 3 including a pilot line connected to the reversing valve, the delay means including a third pilot operated valve disposed between the pilot line and the source of pressurized pilot fluid, said third pilot operated valve being movable between a first position at which the pilot line is isolated from the source of pressurized fluid and a second position at which the pilot line is in communication with the source of pressurized pilot fluid, the third pilot valve being connected to the second signal passage and is moved to the second position when a pilot signal is being communicated to the valve means.

5. The pilot control circuit of claim 4 wherein the valve means includes a shuttle valve having first and second input ports connected to the first and second signal passages and an outlet port connected to the pilot line.

6. The pilot control circuit of claim 5 wherein the pilot operated valve includes a chamber connected to the pilot passage and the another pilot operated valve includes a chamber connected to the another pilot passage, the accumulator means including the chamber of the pilot operated valve, and the another accumulator means including the chamber of the another pilot operated valve.

7. The pilot control circuit of claim 3 wherein the pilot operated valve includes a chamber connected to the pilot passage and the another pilot operated valve includes a chamber connected to the another pilot passage, the accumulator means including the chamber of the pilot operated valve, and the another accumulator means including the chamber of the another pilot operated valve.

* * * * *